US009120209B1

(12) United States Patent
Schevers et al.

(10) Patent No.: US 9,120,209 B1
(45) Date of Patent: Sep. 1, 2015

(54) FASTENER INSTALLATION TOOL AND METHOD OF ASSEMBLING

(75) Inventors: Isaac C. Schevers, St. Louis, MO (US); Sladan Kurtovic, St. Louis, MO (US)

(73) Assignee: The Boeing Company, Chicago, IL (US)

( * ) Notice: Subject to any disclaimer, the term of this patent is extended or adjusted under 35 U.S.C. 154(b) by 282 days.

(21) Appl. No.: 13/585,938

(22) Filed: Aug. 15, 2012

(51) Int. Cl.
*B25B 23/10* (2006.01)
*B25B 13/06* (2006.01)
*B25B 21/00* (2006.01)

(52) U.S. Cl.
CPC ..... *B25B 13/06* (2013.01); *B25B 21/002* (2013.01)

(58) Field of Classification Search
CPC .... B25B 13/06; B25B 13/488; B25B 21/002; B25B 23/0035; B25B 23/0085; B25B 23/10; B25B 23/101; B25B 23/1415; F16B 31/021
USPC ..... 81/55, 56, 471, 124.1, 125
See application file for complete search history.

(56) References Cited

U.S. PATENT DOCUMENTS

| | | | | |
|---|---|---|---|---|
| 2,676,506 | A * | 4/1954 | Schultz | 81/125 |
| 2,805,594 | A | 9/1957 | Fogel | |
| 4,538,483 | A * | 9/1985 | Batten | 81/56 |
| 4,570,513 | A | 2/1986 | Thompson | |
| 4,744,273 | A * | 5/1988 | Bartok, Jr. | 81/125 |
| 5,199,332 | A | 4/1993 | Batten | |
| 5,305,666 | A | 4/1994 | LaTorre | |
| 6,871,570 | B1 | 3/2005 | Santillan | |
| 6,935,209 | B2 * | 8/2005 | Lantow et al. | 81/55 |
| 6,959,625 | B2 | 11/2005 | Pettit, Jr. | |
| 7,287,447 | B2 | 10/2007 | Pettit, Jr. | |
| 7,765,899 | B2 | 8/2010 | Nieh | |
| 7,874,232 | B2 | 1/2011 | Gauthreaux et al. | |
| 7,913,593 | B2 * | 3/2011 | Dahar et al. | 81/452 |
| 8,430,001 | B2 * | 4/2013 | Ortiz | 81/124.1 |

* cited by examiner

*Primary Examiner* — Hadi Shakeri
(74) *Attorney, Agent, or Firm* — Armstrong Teasdale LLP

(57) ABSTRACT

In one embodiment, a device for installing a fastener to couple two or more members is disclosed. The device includes a tool head configured to couple to a power tool and a socket coupled to the tool head. The socket is configured to engage a nut component of the fastener for installation thereof, and a retainer is coupled to the socket. The retainer is configured to retain a portion of the nut component separated during installation of the fastener.

18 Claims, 6 Drawing Sheets

FASTENER INSTALLATION TOOL AND METHOD OF ASSEMBLING

BACKGROUND

This disclosure relates generally to power tools and, more particularly, to the installation of threaded fasteners in aerospace and related industries.

One type of threaded fastener used in the aerospace industry is a frangible threaded fastener such as the Hi-Lok type fastener. Such fasteners are particularly adapted for fastening two or more panels or workpieces together in areas where limited access exists for installation tooling. At least some of such threaded fasteners include a pin or bolt component that has a head and an opposite threaded end, and a nut component that has an internally-threaded body portion and a torque-off drive nut portion. The pin or bolt component is inserted from the rear (relative to the tooling) of an assembly, and the body of the nut component of the fastener is preliminarily threaded onto the exposed threaded end of the pin or bolt component on a front side of the assembly.

Tooling is applied over the nut component to engage the torque-off drive nut portion of the nut component. The tooling substantially prevents the pin or bolt component from rotating while the nut component of the fastener is threaded to the pin or bolt component and until a predefined torque is reached. At the predetermined torque, the drive-nut portion of the nut component is separated from the threaded body of the nut component. As such, the drive-nut portion of the nut component may be lost or may fall inside the manufactured structure where it can be difficult to remove.

BRIEF DESCRIPTION

In one embodiment, a device for installing a fastener to couple two or more members is disclosed. The device includes a tool head configured to couple to a power tool and a socket coupled to the tool head. The socket is configured to engage a nut component of the fastener for installation thereof, and a retainer is coupled to the socket. The retainer is configured to retain a drive-nut portion of the nut component separated during installation of the fastener.

In another embodiment, a fastener retention system for use with a power tool is described. The system includes a socket coupleable to a tool head of a power tool, the socket configured to engage a nut component of a fastener for installation thereof. The system also includes a retainer coupled to the socket, the retainer configured to retain a drive-nut portion of the nut component separated during installation of the fastener.

In yet another embodiment, a method of installing a fastener including a bolt portion and a nut portion, the nut portion including a body portion and a drive portion, is provided. The method includes engaging the bolt portion with a pin to prevent rotation thereof, engaging the nut portion with a socket, and positioning at least a portion of the drive-nut portion within a retainer coupled to the socket. The method further includes rotating the nut component until the drive-nut portion shears off and retaining the drive-nut portion within the retainer.

DETAILED DESCRIPTION

Figure 1:
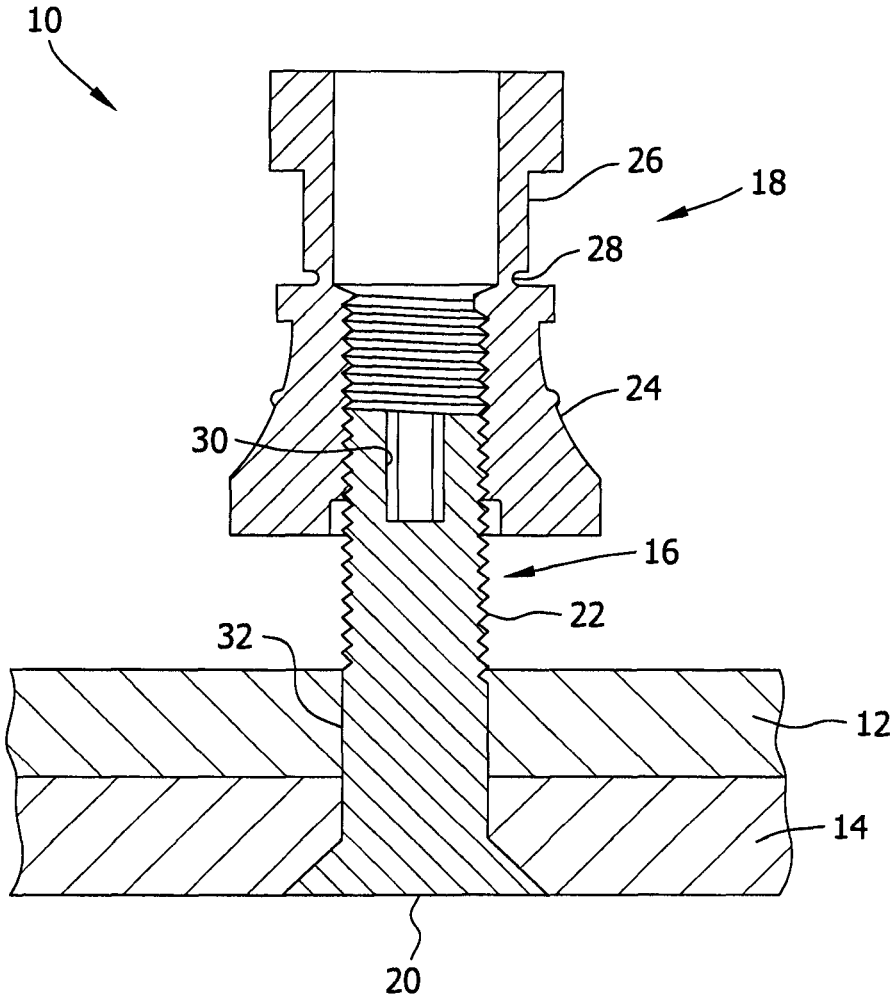
FIG. 1 PRIOR ART
FIG. 1 illustrates an exemplary frangible threaded fastener.

FIG. 1 illustrates an exemplary frangible threaded fastener 10, that may be used to couple a pair of panels or workpieces 12 and 14 together. In the exemplary embodiment, fastener 10 includes a pin or bolt component 16 and a nut component 18. Bolt 16 includes head portion 20 and a threaded portion 22, and nut component 18 includes an internally-threaded body portion 24 and a torque-off drive-nut portion 26 that are spaced apart by a torque-off groove 28. An Allen-type hex shaped recess 30 is formed in threaded portion 22 that is sized to receive the working end of an installation tool (not shown) during installation of fastener 10.

During installation, bolt 16 is inserted through apertures 32 defined in panels 12 and 14. Initially, threaded body portion 24 is manually threaded a few turns onto bolt threaded portion 22. The working end of an installation tool (not shown) is applied to fastener 10 to rotate drive-nut portion 26, while bolt 16 is held stationary, such that body portion 24 is driven down against panel 12 to form a clamping engagement with panels 12 and 14. Drive-nut portion 26 separates from body portion 24 along torque-off groove 28 when a predetermined torque is applied to drive-nut portion 26 such that fastener 10 is coupled in clamping engagement with panels 12 and 14.

Figure 2:
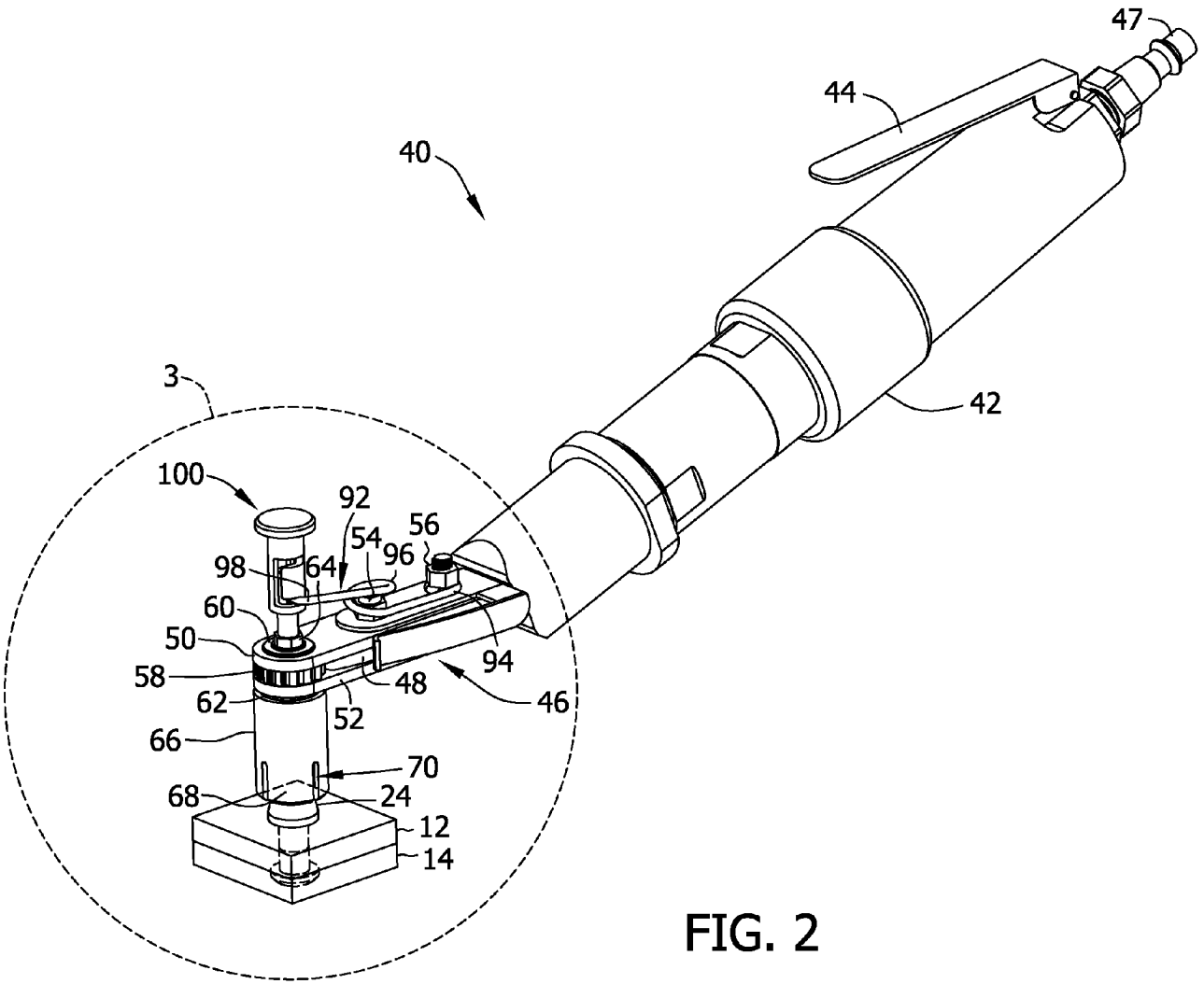
FIG. 2 illustrates an exemplary tool that may be used to install the fastener shown in FIG. 1.
Figure 3:
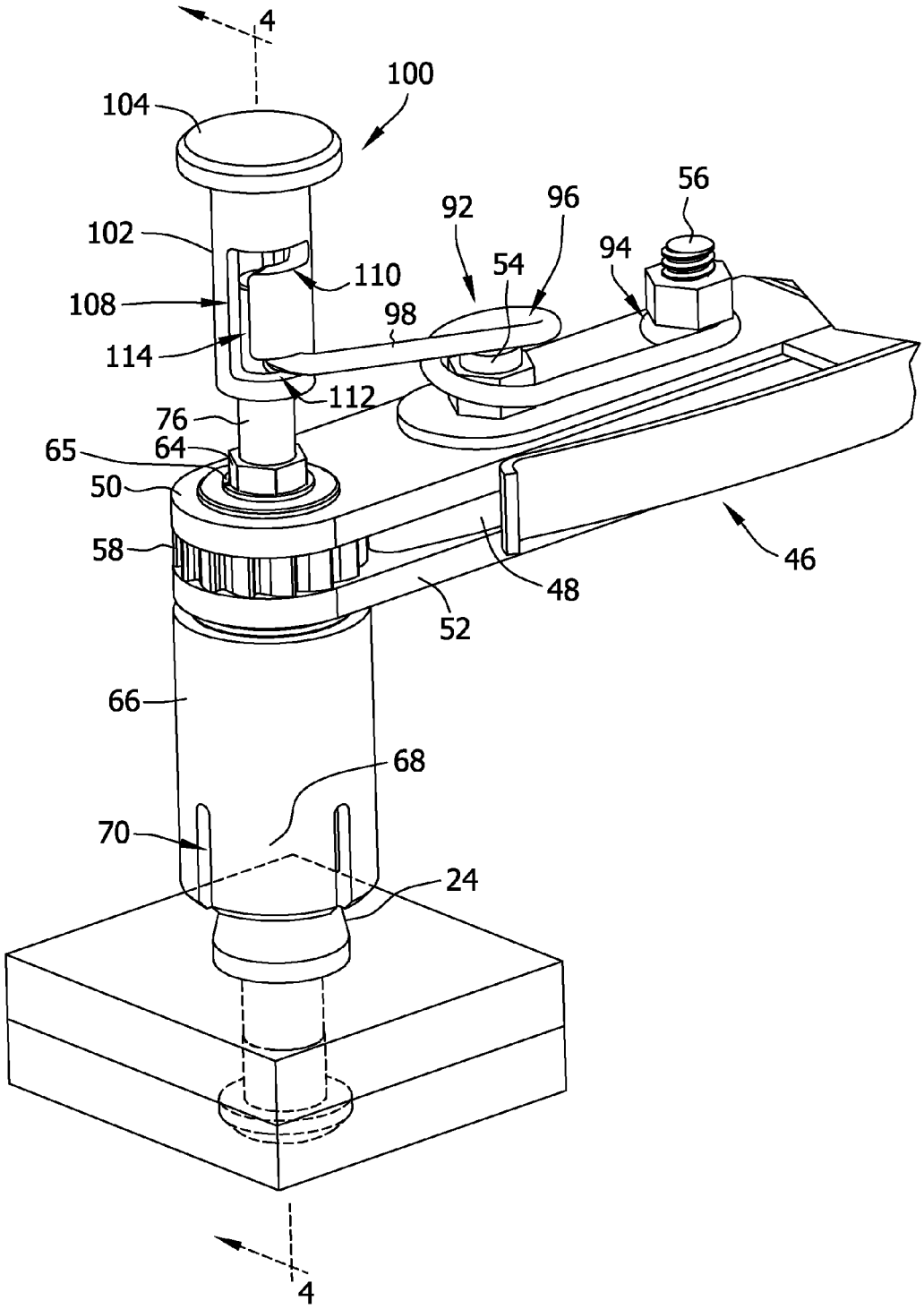
FIG. 3 illustrates an enlarged view of a portion of the tool shown in FIG. 2 and taken along area 3.
Figure 4:
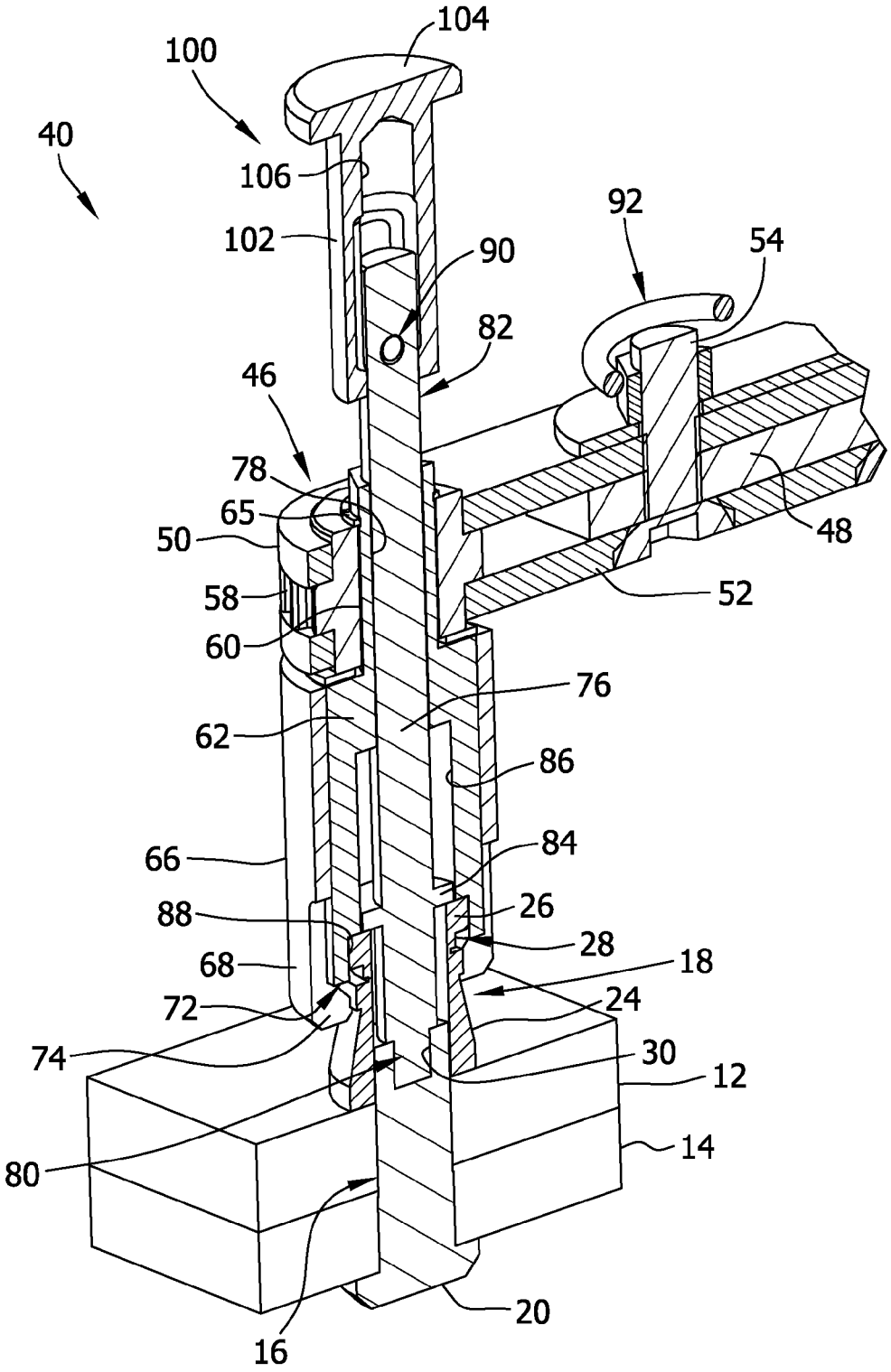
FIG. 4 illustrates a cross-sectional view of the tool shown in FIG. 3 and taken along line 4-4.

FIGS. 2-4 illustrate an exemplary power tool or fastener installation tool 40 that includes a body 42, a lever 44, and a tool head 46. Specifically, FIG. 2 is a perspective view of power tool 40, FIG. 3 is an enlarged view of section 3 of FIG. 2, and FIG. 4 is a cross-sectional view of FIG. 3 taken along line 4-4. In the exemplary embodiment, body 42 includes a motor (not shown) that is driven by compressed air supplied through a pneumatic port 47, and the motor energizes tool head 46 when lever 44 is actuated. Tool head 46 is coupled to body 42 via a support plate 48. Spaced, parallel upper and lower head plates 50 and 52, respectively, are secured against support plate 48 by bolts 54 and 56. A drive gear 58 is rotatably coupled between plates 50 and 52. In the exemplary embodiment, drive gear 58 includes a hex-shaped aperture 60 defined therein. Alternatively, aperture 60 may have any shape that enables power tool 40 to function as described herein. A socket 62 is coupled to drive gear 58 with a hex portion 64 that is sized and shaped to be at least partially inserted through hex aperture 60. A retaining ring 65 facilitates locking socket 62 and a retainer 66 in position with tool head 46 and to restrict relative movement therebetween during a fastening operation. In the exemplary embodiment, power tool 40 transmits rotary motion through a gear train (not shown) to drive gear 58, which provides rotary power to socket 62. Alternatively, tool 40 may be a hand operated tool that transfers rotary motion by user.

In the exemplary embodiment, retainer 66 is coupled to socket 62. Retainer 66 and socket 62 are substantially concentrically aligned. Retainer 66 includes an inner diameter that is slightly larger than an outer diameter of socket 62 to facilitate a tight engagement between retainer 66 and socket 62. Alternatively, retainer 66 and socket 62 may have any other shape or orientation that enables power tool 40 to function as described herein. Retainer 66 substantially circumscribes socket 62 and includes a plurality of tabs 68 defined by slots 70 formed in retainer 66. In the exemplary embodiment, retainer 66 includes four tabs 68. Alternatively, retainer 66 may include any number of tabs 68 that enables retainer 66 to function as described herein. Each tab 68 extends below a lower end 72 of socket 62, and a flange or collar 74 extends from each tab 68 inwardly past the inner diameter of socket 62. As such, collar 74 is positioned to retain drive-nut portion 26 within retainer 66, as is described in more detail herein. In the exemplary embodiment, retainer 66 is fabricated from a polymer material, and slots 70 enable tabs 68 to flex outwardly to facilitate removal of drive-nut portion 26, as is described in more detail herein. Alternatively, retainer 66 does not include tabs 68 or slots 70 and is fabricated from any material that enables retainer 66 to function as described herein.

In the exemplary embodiment, a pin 76 is supported within tool head 46 by a slide-fit mounting in a first central bore 78 defined in socket 62. Moreover, in the exemplary embodiment, central bore 78 has a substantially circular cross-sectional shape formed in socket 62 such that pin 76 is operable for relative movement with socket 62. Pin 76 includes a first end 80, an opposite second end 82, and a shoulder 84 defined therebetween. First end 80 extends below socket lower end 72 and has a hexagonal shape that is complementary to recess 30 to facilitate a mating engagement with, and rotation constraint of, bolt 16, as described in more detail herein. Shoulder 84 projects from pin 76 and is operable for relative movement within a second central bore 86 and a third central bore 88 formed within socket 62.

In the exemplary embodiment, pin second end 82 extends above support plate 50 and includes an aperture 90 that is sized shaped to receive a portion of a biasing member, for example spring 92. Biasing member 92 limits rotation of pin 76 and includes an anchor loop 94 that is retained by bolt 56, an extension loop 96 that is spaced about bolt 54, and a retention arm 98 that extends into aperture 90. Biasing member 92 substantially prevents rotation of pin 76 and biases pin 76 toward an at-rest position during operation of power tool 40. For example, when pin second end 82 is moved away from tool head 46, biasing member 92 biases pin second end 82 toward tool head 46 into the at-rest position. Similarly, when pin first end 80 is translated away from tool head 46, biasing member 92 biases pin first end 80 toward tool head 46 into the at-rest position.

In the exemplary embodiment, a handle 100 is slidably coupled to pin second end 82. Handle 100 facilitates transfer of force to pin 76 and includes a body portion 102 and a cap 104 that enables pushing and pulling movement of pin 76 by a user. Body portion 102 includes a bore 106 that has a diameter that is slightly larger than the diameter of pin second end 82, and a slot 108 that is formed therein. Slot 108 enables spring retention arm 98 to extend into aperture 90, as is shown in FIG. 3. Slot 108 includes an upper transverse section 110, an opposite lower transverse section 112, and a vertical section 114 that extends therebetween. Upper transverse section 110, lower transverse section 112, and vertical section 114 are each larger in width than the diameter of retention arm 98 such that handle 100 can be rotated about or selectively moved along pin 76 to enable retention arm 98 to be positioned along any point of slot 108.

Figure 5:
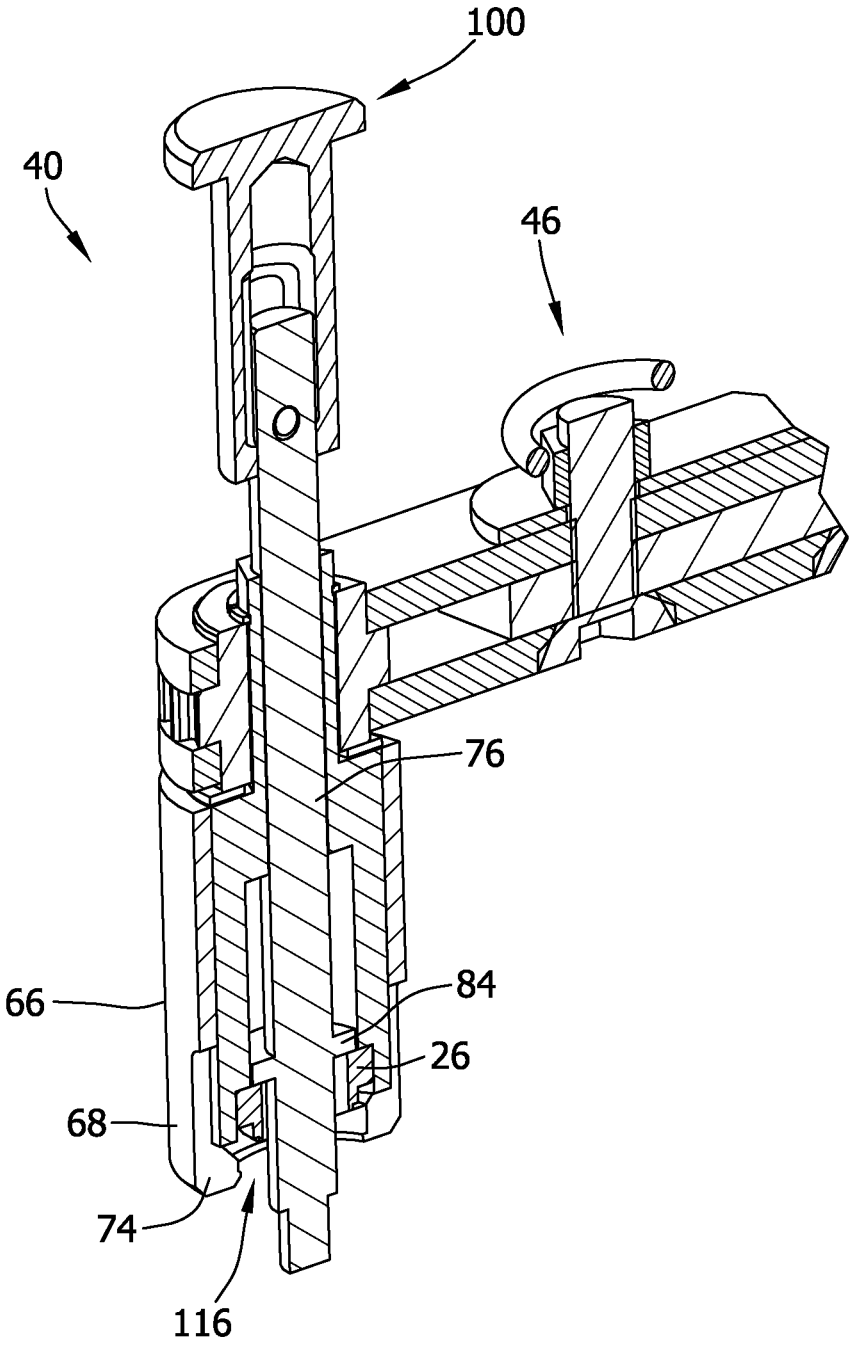
FIG. 5 illustrates a cross-sectional view of a portion of the tool shown in FIG. 2 in a first position after installation of the frangible threaded fastener.
Figure 6:
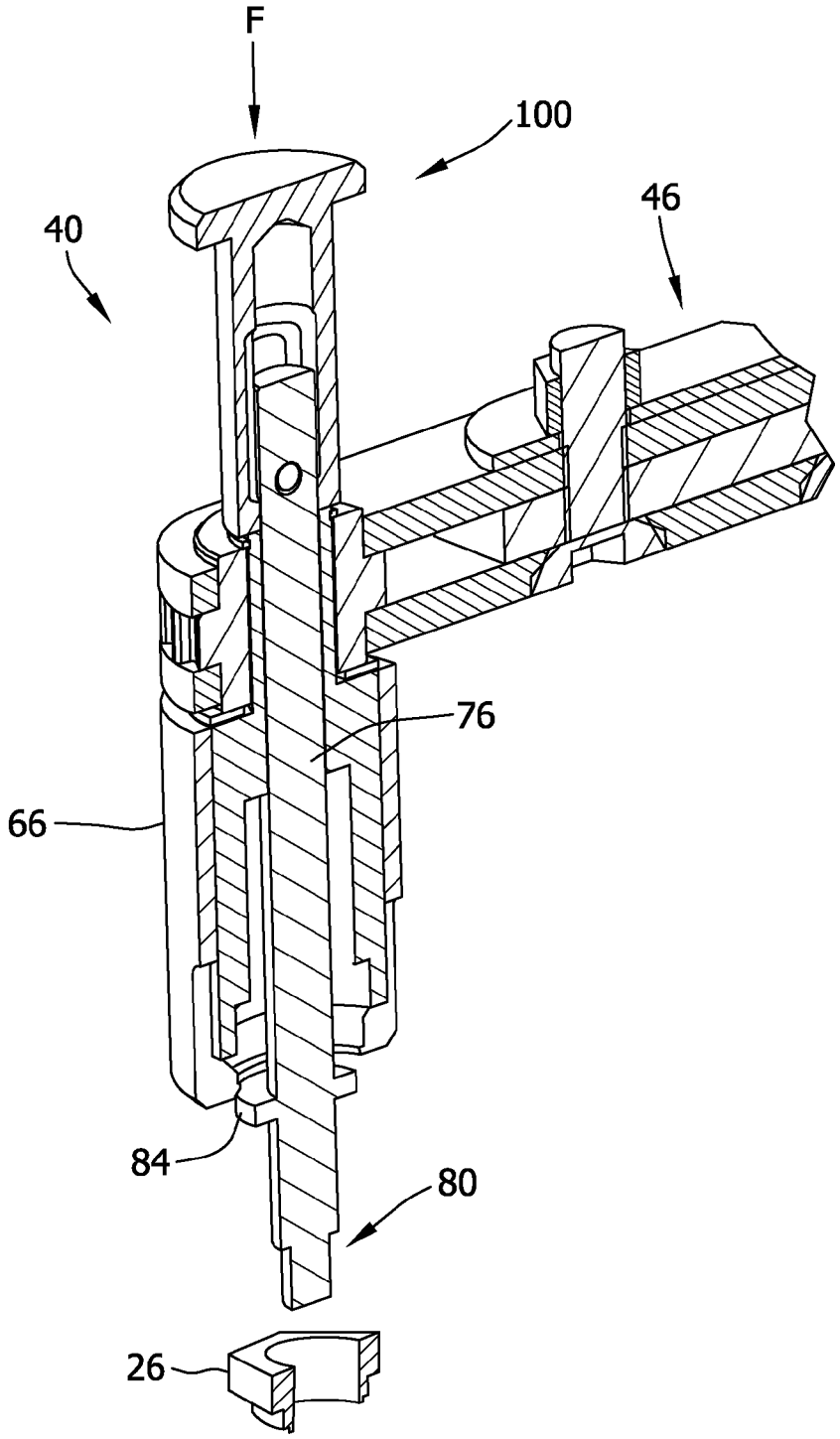
FIG. 6 illustrates a cross-sectional view of the tool shown in FIG. 4 in a second position.

FIGS. 4-6 illustrate the operation of installing fastener 10 with exemplary power tool 40. Specifically, FIG. 4 illustrates power tool 40 installing fastener 10, FIG. 5 illustrates power tool 40 removed from the installation area of fastener 10 and in a first position, and FIG. 6 illustrates power tool 40 in a second position to eject drive-nut portion 26. As shown in FIG. 4, in the exemplary embodiment, bolt 16 is inserted through apertures 32 formed in panels 12 and 14. Nut component 18 is manually threaded to pin threaded portion 22, and tool head 46 is positioned against fastener 10 such that third central bore 88 of socket 62 extends about drive-nut portion 26, and such that pin first end 80 is positioned within bolt recess 30. Spring 92 biases pin 76 towards bolt 16 to maintain pin first end 80 within hex recess 30. At this time, an operator forces tool head 46 against fastener 10 and actuates the motor (not shown) within power tool body 42. The motor transfers rotary motion to drive gear 58 such that socket 62 is rotated and such that drive-nut portion 26 and body portion 24 are rotated until panels 12 and 14 are secured between body portion 24 and bolt head 20. Nut component 18 shears along torque-off groove 28 and drive-nut portion 26 is separated from nut body portion 24 when a predetermined torque is induced to drive-nut portion 26. The predetermined torque has not been induced in FIG. 4, but has been achieved in FIG. 5.

After fastener 10 is installed and drive-nut portion 26 is sheared from nut body portion 24, power tool 40 is removed from fastener 10, and drive-nut portion 26 is retained within socket 62 and/or retainer 66 by collar 74, as shown in FIG. 5. More particularly, in the exemplary embodiment, an aperture 116 defined by collar 74 is sized smaller than the diameter of drive-nut portion 26 such that drive-nut portion 26 cannot fall through aperture 116 without assistance.

As shown in FIG. 6, after power tool 40 is removed from the installation area, a force F is applied to handle 100 generally in the direction of tool head 46, which translates pin shoulder 84 towards drive-nut portion 26 retained within retainer 66. Shoulder 84 then contacts drive-nut portion 26 and pushes it against retainer tabs 68, which flex outwardly under the force application and enable drive-nut portion 26 to be selectively ejected from retainer 66. In the exemplary embodiment, a user pushes handle 100, which translates shoulder 84 and ejects drive-nut portion 26. Alternatively, translation of handle 100 and/or pin 76 is automated in any manner that enables power tool 40 to function as described herein. For example, an electric motor (not shown) provides force F to translate pin 76 within socket 62. In the exemplary embodiment, once drive-nut portion 26 is ejected from retainer 66 and force F applied to handle 100 is removed, spring 92 biases pin 76 to return to the position shown in FIG. 5. Alternatively, the user may apply a pulling force opposite force F on handle 100 to slide pin 76 and return shoulder 84 to the position shown in FIG. 5.

In the exemplary embodiment, the height position of handle 100 is adjustable to enable power tool 40 to fit into small installation spaces. As shown in FIG. 3, spring retention arm 98 is positioned within lower transverse section 112 of slot 108 such that handle 100 is locked in a telescoped first position. This position prevents drive-nut portion 26 from being prematurely ejected from retainer 66, for example, if pin first end 80 is stuck or otherwise engaged within hex recess 30 when power tool 40 is removed from fastener 10. To adjust the height of handle 100 to a lower, collapsed second position (not shown), handle 100 is rotated counterclockwise until retention arm 98 is positioned at the bottom of slot vertical section 114. Handle 100 is then pushed downwards until retention arm is positioned at the top of slot vertical section 114. Handle 100 is then rotated clockwise until retention arm 98 is positioned at the distal end of upper transverse section 110, locking handle 100 in the collapsed second position, which provides power tool 40 with a smaller size profile.

An exemplary method of assembling a fastener retaining power tool is described herein. A fastener installation tool 40 is provided, which includes a body 42, a lever 44, and a tool head 46. Tool head 46 includes a drive gear 58 having a hex aperture 60, and drive gear 58 is driven by rotary motion provided by a motor (not shown) within body 42. A socket 62 is provided having a hex portion 64, and first, second and third central bores 78, 86 and 88, respectively. Socket 62 is coupled to tool head 46 by inserting hex portion 64 into aperture 60. A retainer 66 is provided having at least one tab 68 defined by slots 70, and a collar 74 extending inwardly from tab 68. Retainer 66 is coupled to socket 62 such that the inner diameter of retainer 66 is fitted against the outer diameter of socket 62, and collar 74 is positioned below socket lower end 72. A pin 76 is provided having a first end 80, a second end 82 and a shoulder 84 therebetween. Pin 76 is slidably coupled to socket 62 within first central bore 78 such that pin first end 80 extends outwardly from socket 62 and shoulder 84 is positioned within second central bore 86. A handle 100 is provided having a tubular body portion 102 and a cap 104. Handle 100 is movably coupled to pin 76 by positioning body portion 102 over pin second end 82 such that the inner diameter of body portion 102 is fitted against the outer diameter of pin 76, the inner diameter of body portion 102 sized to allow handle 100 to slide along and to rotate about pin 76. Tool head 46 further includes a biasing member such as spring 92 that includes a retention arm 98, which is at least partially inserted into an aperture 90 formed in pin 76.

As described above, exemplary power tool or fastener installation tool 40 provides management of a fastener portion that is sheared off during installation of the fastener. Retainer 66 is easily assembled onto installation tool 40 and enables sheared drive-nut portion 26 to be retained by power tool 40 until selective ejection of the waste. In this way, unwanted foreign objects are prevented from falling into and/or getting stuck in surrounding structure, which can require time consuming and exhaustive efforts to remove the objects. Exemplary power tool 40 thereby facilitates the safe and secure removal of fastener waste from the installation area to a suitable disposal location. Moreover, collapsible handle 100 enables power tool 40 to be used for fastener installation in small spaces, particularly in aircraft applications. Thus, described herein is an improved fastener installation tool.

This written description uses examples to disclose various embodiments, including the best mode, and also to enable any person skilled in the art to practice the described embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A device for installing a fastener to couple two or more members, said device comprising:

a tool head configured to couple to a power tool, said tool head comprising a drive gear having an aperture defined therethrough;

a socket coupled to said drive gear such that a portion of said socket extends through said aperture, said drive gear configured to rotate said socket, said socket configured to engage a nut component of the fastener for installation thereof;

a pin extending at least partially through said socket;

a handle slidably coupled to said pin, wherein said handle is movable relative to said pin between a telescoped position and a collapsed position; and a retainer coupled to said socket, said retainer configured to retain a drive-nut portion of the nut component separated during installation of the fastener.

2. The device of claim 1, wherein an end portion of said pin is configured to engage a bolt component of the fastener.

3. The device of claim 2, wherein said pin comprises a shoulder portion spaced an axial distance from said end portion, said shoulder portion configured to selectively engage the separated portion of the fastener in said retainer, said shoulder portion operable to eject the separated portion therefrom.

4. The device of claim 3, wherein said pin is slidably coupled to said socket.

5. The device of claim 2, wherein said handle is configured to facilitate selective movement of said pin to engage the separated portion of the fastener and eject the separated portion from said retainer.

6. The device of claim 5 further comprising a biasing member coupled to said tool head and said pin, said biasing member configured to substantially prevent rotation of said pin and to bias said pin toward an at-rest position.

7. The device of claim 1, wherein said retainer comprises an inwardly-extending collar configured to:

engage the drive-nut portion of the fastener; and retain the drive-nut portion of the fastener within said retainer when separated from a body portion of the nut component.

8. The device of claim 7, wherein said retainer comprises at least one tab upon which said inwardly-extending collar is disposed, said at least one tab configured to flex outward to facilitate removal of the retained separated portion of the fastener from said retainer.

9. The device of claim 1, wherein said retainer and said socket are concentric.

10. A fastener retention system for use with a power tool, said system comprising:

a socket coupleable to a tool head of a power tool, said socket configured to engage a nut component of a fastener for installation thereof;

a retaining ring coupled about said socket, said retaining ring configured to restrict relative movement between said socket and the tool head;

a pin slidably coupled to said socket;

a handle slidably coupled to said pin, wherein said handle is movable relative to said pin between a telescoped position and a collapsed position; and a retainer coupled to said socket, said retainer configured to retain a drive-nut portion of the nut component separated during installation of the fastener.

11. The system of claim 10, wherein an end portion of said pin is configured to engage a bolt component of the fastener.

12. The system of claim 11, wherein said pin comprises a shoulder portion spaced an axial distance from said end portion, said shoulder portion configured to selectively engage the separated portion of the fastener retained in said retainer, said shoulder portion operable to eject the separated portion therefrom.

13. The system of claim 11, wherein said handle is configured to facilitate selective movement of said pin to facilitate engaging the separated portion of the fastener and ejecting the separated portion from said retainer.

14. The system of claim 10, wherein said retainer comprises an inwardly extending collar configured to engage the drive-nut portion of the fastener and to retain the drive-nut portion within said retainer when separated from a body portion of the nut component.

15. The system of claim 14, wherein said retainer comprises at least one tab upon which said inwardly-extending collar is disposed, said at least one tab configured to flex outward to facilitate removal of the retained separated portion of the fastener from said retainer.

16. A method of installing a fastener including a bolt portion and a nut portion, the nut portion including a body portion and a drive-nut portion, said method comprising:

engaging the bolt portion with a pin to prevent rotation thereof;

engaging the nut portion with a socket, wherein the pin is slidably coupled to the socket;

positioning at least a portion of the drive-nut portion within a retainer coupled to the socket;

rotating the nut portion by rotating the socket until the drive-nut portion shears off, wherein the socket is rotated by a drive gear having an aperture defined therein through which a portion of the socket extends to facilitate rotation of the socket;

retaining the drive-nut portion within the retainer; and adjusting a handle slidably coupled to the pin from a collapsed position to a telescoped position relative to the pin.

17. The method of claim 16, further comprising translating the pin such that a pin shoulder portion engages the separated drive-nut portion, said shoulder portion operable to eject the separated drive-nut portion from the retainer.

18. The method of claim 17, further comprising ejecting the separated drive-nut portion from the retainer.

* * * * *